US005855337A

United States Patent [19]

Schönmeier et al.

[11] Patent Number: 5,855,337

[45] Date of Patent: Jan. 5, 1999

[54] WINDING MACHINE WITH SUPPORT CYLINDERS AND AIR PRESSURE RELIEVED WIND UP ROLLS

[75] Inventors: Herbert Schönmeier, Dusseldorf; Peter Hoffmann, Korschenbroich; Hartmut Dropczynski, Dormagen; Reinhard Schönen, Korschenbroich, all of Germany

[73] Assignee: Jagenberg Aktiengesellschaft, Dusseldorf, Germany

[21] Appl. No.: 322,731

[22] Filed: Oct. 13, 1994

Related U.S. Application Data

[63] Continuation of Ser. No. 849,022, filed as PCT/EP91/01555 Aug. 16, 1991 published as WO92/03366 Mar. 5, 1992, abandoned.

[30] Foreign Application Priority Data

Aug. 23, 1990 [DE] Germany ..... 40 26 597.8
Mar. 27, 1991 [DE] Germany ..... 41 10 047.6

[51] Int. Cl.[6] ..... B65H 18/14; B65H 18/26

[52] U.S. Cl. ..... 242/541.7; 242/542; 242/542.3

[58] Field of Search ..... 242/66, 65, 56.2, 242/541.7, 542, 542.3; 277/53

[56] References Cited

U.S. PATENT DOCUMENTS 3,346,209 10/1967 Cornin ..... 242/541.7
3,497,151 2/1970 Voss ..... 242/541.7
4,483,493 11/1984 Schonmeier ..... 242/541.7
4,895,315 1/1990 Salmela et al. ..... 242/541.7
4,969,609 11/1990 Scheuter ..... 242/541.7
4,993,310 2/1991 Sackenreuter et al. ..... 277/534

FOREIGN PATENT DOCUMENTS 1 047 001 12/1958 Germany .
1 111 496 8/1963 Germany .
3 618 955 12/1987 Germany .

*Primary Examiner*—John Q. Nguyen
*Attorney, Agent, or Firm*—Herbert Dubno

[57] ABSTRACT

In a winding machine, the space defined by the support cylinders and the winding rolls is sealed and an overpressure is created in this space to relieve the force with which the winding rolls press against the support cylinders. For the purpose, in the area of the two lateral ends of the support cylinders sealing elements are arranged, which for adjustment to various web widths, are axially displaceable and at the same time can be moved away to an area outside the motion range of guide heads and their mounting. In the sealing position of the sealing elements, a fictional-look connection with the support cylinders is avoided.

14 Claims, 8 Drawing Sheets

WINDING MACHINE WITH SUPPORT CYLINDERS AND AIR PRESSURE RELIEVED WIND UP ROLLS

CROSS REFERENCE TO RELATED APPLICATION

This application is continuation of application 07/849,022 filed on 21 Apr. 1992 (now abandoned) as national phase of PCT/EP91/01555 filed 16 Aug. 1991 published as WO92/03366 Mar. 5, 1992 and based, in turn, on German National Application P 40 26 597.8 of 23 Aug. 1990 and P 41 10 047.6 filed 27 Mar. 1991 under the International Convention.

FIELD OF THE INVENTION

Our present invention relates to a winding machine with support cylinders. More particularly the invention relates to a winding machine with support cylinders for winding longitudinally sectioned webs of material, particularly paper or cardboard webs, onto cores with two support cylinders whereupon the winding rolls rest during the winding operation, and which have at each frontal side of the support cylinders a vertically displaceable guide head which can be lowered into the area of the upper wedge between the support cylinders, these guide heads being insertable in the cores of both outer winding rolls for holding.

The invention also relates to a method of winding webs of material particularly paper or cardboard webs onto cores, wherein the winding rolls rest on two support cylinders during winding and are held by lateral guide heads.

BACKGROUND OF THE INVENTION

Such winding machines with support cylinders serve for the axleless winding of longitudinally sectioned webs of material, particularly paper or cardboard onto cores, whereby the winding rolls are positioned in alignment on the support cylinders during winding. Different from the so-called axle winding, wherein a set of winding rolls is held during winding by means of an axle passing through all cores, in the axleless winding two guide heads are introduced from outside into the cores of the outer winding rolls.

With the winding machines with support cylinders known from DE-A 36 18 955, winding rolls with the required winding quality can be produced only up to a certain diameter. The reason for that is that the winding hardness of the roll is influenced by the line load (=contact weight per width of a winding roll) at the two contact lines of the winding roll on the support cylinders.

The winding hardness should be as even as possible for the entire set of winding rolls and over the diameter of each individual winding roll and to have a predetermined value, which is exceeded in the case of the known winding machines with support cylinders from a certain diameter up, due to the increasing contact weight, thereby limiting the maximum diameter of the winding rolls.

In order to relieve the dead load in winding machines with support cylinders with axle winding it is known from German Patent 11 11 496 to create overpressure in the space defined between the support cylinders and the winding roll. For the lateral sealing of this hollow space serve cover plates fitted to the shape of the support cylinders, which plates can be displaced in order to be placed against the frontal side of the winding rolls. The sealing of the bottom portion is done by a cylinder or group of cylinders arranged tangentially with respect to the two support cylinders.

The sealing elements described in German Patent 11 11 496 are not suited for use in winding machine with support cylinders based on axleless winding, since their fastening elements are located within the motion range of the guide heads. Furthermore, a frictional engagement is created between the two support cylinders due to the sealing cylinder pressing thereagainst, which precludes the setting of variable rolling momentums for the purpose of influencing the quality of the winding process.

OBJECT OF THE INVENTION

It is an object of the invention to provide a winding machine with support cylinders based on axleless winding capable of producing large-diameter rolls with high winding quality.

Another object is to obviate the drawbacks of earlier winding machines.

SUMMARY OF THE INVENTION

These objects are attained, in accordance with the invention by means for sealing the space defined between the support cylinders and the winding rolls and by the creation of an overpressure in this space, whereby in the area of both lateral ends of the support cylinders, at least in the cross-sectional area of the upper wedge between the two support cylinders, sealing elements are arranged, which are axially displaceable and at the same time are movable in an area outside the motion range of the guide heads and their mountings (sliding carriages, for the purpose of adjustment to various web width. The sealing elements in sealing position do not establish a frictional lock connection between the two support cylinders.

The winding machine with support cylinders according to the invention has the advantage of axleless winding (no cumbersome handling of a long and heavy axle, particularly at large web widths; rapid roll replacement), without limiting the maximum roll diameter as a result of the contact weight. Furthermore, the load-relieving overpressure provides an additional setting parameter, through which the winding hardness can be controlled or adjusted.

The supply of compressed air from underneath through the gap between the support cylinders makes possible to arrange the elements feeding the compressed air beneath the support cylinders; in addition the compressed air blown in from below can also serve as a sealing air barrier.

The vertical adjustability the lower sealing element can be insured by lifting or swivel elements. On the one hand, this serves the purpose of keeping the sealing element away from the support cylinders, e.g. for instance to remove paper residues after a paper jam. On the other hand, it can be lowered so far that the frontally arranged sealing elements on the upper side of the sealing element are no longer within the motion range of the guide heads.

Due to the swingability of the lower sealing elements until it reaches the area underneath a support cylinder, a free space is created for the cutting knife which during a roll replacement is lifted through the gap between the support cylinders. Such cutting knives can be used as long as the feeding of the web takes place from underneath through the gap between the support cylinders.

The bottom-sealing element (air receiver) can extend over the ends of the support cylinders and on the upper side the frontal sealing elements are fastened so as to be axially displaceable. In this embodiment the frontal sealing an embodiment wherein the frontal sealing elements can be axially removed from the area of the support cylinders. Thereby, the removal from the area of the guide heads takes place either through a further axially outward displacement or through an additional lowering, as soon as they leave the area of the support cylinders.

The frontal sealing elements can be are supported so that they can swing over one of the support cylinders. The frontal sealing elements can be subdivided into parts, whereby each part can swing over one of the support cylinders. The frontal sealing elements then can be removed from the area of the guide heads through a swivel motion. The subdivision has the advantage of requiring little space for the respective swivel motion. In this way, the sealing elements can already be used at a smaller roll diameter, when the guide heads are still further below; i.e. the overpressure can be applied at an earlier moment in time during winding, in order to gain impact on the winding process.

The frontal sealing elements can be supported on round guides extending parallel to the support-cylinder axis, whereby the round guides are fastened to lateral swivel arms whose swivel axis runs along a support-cylinder axis or slightly eccentrically and outwardly offset in the direction of the connection line between the two support cylinders. This embodiment with round guides fastened to swivel arms and supporting the frontal sealing elements is an advantageous and space saving construction. A slightly eccentric and outward displacement of the swivel axis with respect to the axis of the support cylinders in the claimed form causes the sealing elements to move away slightly from one of the support cylinder while swinging over it. In this way paper residues, e.g. after a paper jam, can be removed without problems. Thereby the sealing elements are mounted either at the inner end of the round guide, in this case the guides being supported outwardly swingable in the swivel arms, or the swivel arms are angularly shaped, whereby the apex of the angles lies outside the support-cylinder area. Then continuous round guides extending over the entire work width can be fastened to the swivel arms, to which the sealing elements are slidably mounted. Thus, the round guides do not have to be moved outwardly over the support cylinders when the machine is set to maximum web width.

The swivel arms can have an angular shape outside the area of the support cylinders, whereby the round guides extending over the entire work width are fastened to the vertices of these angles.

The sealing surfaces of the sealing elements can have grooves running transversely to the outgoing flow direction, these grooves acting like labyrinth packing.

The sealing surfaces of the sealing elements can have outlet openings for the compressed air directed against the outgoing flow direction.

The sealing elements provided with labyrinth packing insure a sealing without friction with a winding roll or a support cylinder. In the embodiment wherein the compressed air is directed against the outflow direction the sealing effect can be enhanced by creating an air barrier.

The sealing can be achieved by means of sealing elements such as brushes, rubber lips or felt layers fastened to the sealing surfaces of sealing elements, resting with little friction against the winding rolls and the support cylinders, or positioned at a short distance therefrom. This embodiment of the sealing surfaces with sealing elements can afford a high sealing effect with very low friction.

The axially displaceable lateral sealing elements can be pressed against the frontal sides of the outer winding rolls by means of a controllable pneumatic piston-cylinder unit. The pneumatic piston-cylinder unit serves at the same time for the axial displacement of the sealing elements for the purpose of adjustment to various web width. An additional electric or hydraulic drive can be provided for the axial displacement of the sealing elements.

The lateral sealing elements can be supported on a straight guide parallel with respect to the support-cylinder axis and that the pneumatic piston cylinder unit can be fastened to the sealing element so that it is movable about the axes perpendicular to the guide. This construction makes it possible to provide a lateral sealing with minimal losses of compressed air at variable overpressure values. It is possible to establish a balance of forces between the pressure force applied by the pneumatic piston-cylinder unit and the counterforce generated by the overpressure, so that automatically the gap between the sealing elements and the frontal side of the utmost winding roll is kept to a minimum. If the gap is reduced or increased due to an axial slip of the winding roll, the overpressure increases or decreases, so that the increased or reduced counterforce triggers a correcting motion of the sealing element.

The pneumatic piston-cylinder unit serves constructively also in an advantageous manner for the axial displacement of the sealing element, insuring adjustment to various web widths.

The mobile mounting of the pneumatic piston-cylinder units about axes running perpendicular to the axially parallel guide insures the free mobility of the sealing elements at the guides.

In the method of winding a web of material, the contact weight of the winding rolls is kept constant through the winding process by an adjusted or controlled supply of compressed air to the space defined between the support cylinders and the winding rolls, creating an overpressure which permanently compensates the weight increment, makes possible the winding of rolls with very large diameters, whereby the control and adjustment of the winding hardness are considerably simplified, since one of the decisive values, namely the line load at the two contact lines between the winding rolls and the support cylinders no longer changes.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
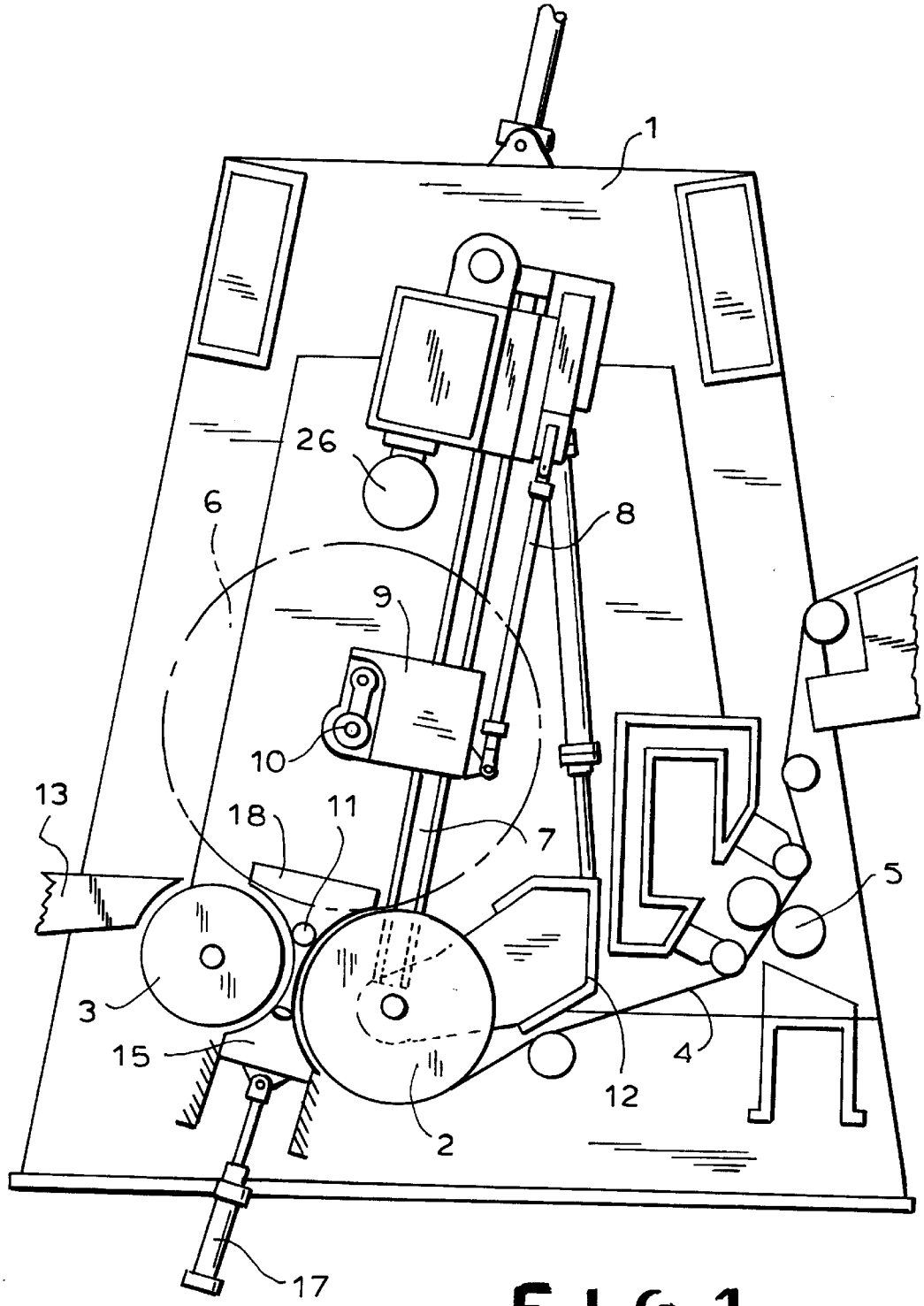
FIG. 1 is a side elevational view of a winding machine with support cylinders according to the invention.

The double-cylinder winding machine, whose parts pertaining to the invention are the only ones described in detail, has two support cylinders 2, 3, supported on machine stand 1. These are arranged axially parallel at a small distance from each other and extend over the entire work width, i.e. the maximum width of the material web 4 to be wound. The diameters of the support cylinders 2, 3 are either different and then the axes of rotation are slightly offset in their height (FIGS. 1 to 3), or the diameters are equal and then the axes of rotation lie in the same horizontal plane (FIGS. 4 to 10). A longitudinal cutting device 5 serves for the subdivision of the material web 4 in individual webs, from which winding rolls 6 are wound, which during winding are arranged in mutual alignment on the two support cylinders 2, 3, in a row next to each other. The feeding of the web 4 to the winding location takes place either from below through the gap between the support cylinders (FIGS.1, 4, 8) or from above, slightly wrapped around one support cylinder (FIG. 6).

On both sides of the machine in the stand 1 approximately vertical guides 7 are provided for a sliding carriage 9 bearing an inwardly extending guide head 10 and movable up and down by means of a piston-cylinder unit 8. In order to guide the set of winding rolls 6 in an axial direction during winding, each of the two guide heads 10 is pushed from the outside into the two outer cores 11 prior to winding, and remains there until the winding of rolls 6 is finished. For their insertion in empty core 11 and for the adjustment to various web widths, the guide heads 10 are mounted on sliding carriage 9 axially slidable by means of a drive. For this purpose, the sliding carriage 9 has an inwardly extending guide shaped like a hollow cylinder, wherein a pin is axially movable by means of a spindle, the guide head 10 being mounted to the end of the pin. This construction is described in detail in U.S. Pat. No. 4,483,493.

The guides 7 run outside the area of the upper wedge between the two support cylinders 2, 3, at a distance and parallel to the normal to the connection line between the two support-cylinder axes through the middle of the gap between the support cylinders. They end slightly above the connection line between the two support-cylinder axes. The guide heads 10 can be introduced in the cores 11 which are located in the wedge between the two support cylinders 2, 3. As soon as the lower edge of sliding carriage 9 has moved sufficiently upward along guides 7 with the cores 11 bearing the increasingly larger rolls 6, on both sides of the machine a free space becomes available above the support cylinders 2, 3 and collisions with the later to be described sealing elements can be avoided.

For roll replacement, the machine has a roll discharge bar 12 and a drop plate 13 which receives the finished rolls 6 and lowers them for discharge. When the web feeding is done from below, underneath the support cylinders 2, 3 a cutting knife 5 upwardly mobile through the gap between the support cylinders can be provided for the transverse separation of web 4, as shown in FIG. 6.

In order to reduce the contact weight of the winding rolls 6 on the support cylinders 2, 3, in the space defined between the winding rolls 6 and the support cylinders 2, 3 an overpressure can be created with the aid of compressed air.

In all embodiments illustrated in the drawing an air distributor 15, 115, 215, 315 with a compressed air feed can be seen in the lower wedge between the two support cylinders 2, 3, this air receiver extending at least over an area of minimal width of web 4 and having outlet openings for the compressed air on its upper defining surface facing the winding rolls 6. The air distributor 15, 115, 215, 315 is mounted with its bottom side to lift or pivot elements, so that it can be lowered. When under the support cylinders 2, 3 a cutting knife 14 raisable through the gap between the support cylinders is provided, pivot arms 16, 116 are fastened to the air distributor 15, 315 so that the latter can be swung away underneath one support cylinder (support cylinder 3 in FIGS. 4 and 8), in order to make room for the raising cutting knife 14. In the absence of such a cutting knife, the air distributor 15 is lowered (FIGS. 1, 6) by means of lifting elements (lifting cylinder 17 or 117). The surfaces of the upper part of the air distributor 15 facing the support cylinders 2, 3 are curved to accommodate the surfaces of the support cylinders 2, 3, whereby in the sealed position only a small gap remains, in order to avoid friction. On their sides facing the support cylinders 2, 3, the lateral surfaces have several grooves running parallelly to the axes of the support cylinders, which by running across the flow direction of the exiting compressed air form a labyrinth seal. The height of the lateral surfaces acting as seals is determined by the sealing effect to be provided. It can be shorter on the side of support cylinder 2 which moves into the upper wedge than on the other side, since due to the direction of rotation, the support cylinder 2 or the material web 4 supported thereon carry along air in counterflow.

Figure 3:
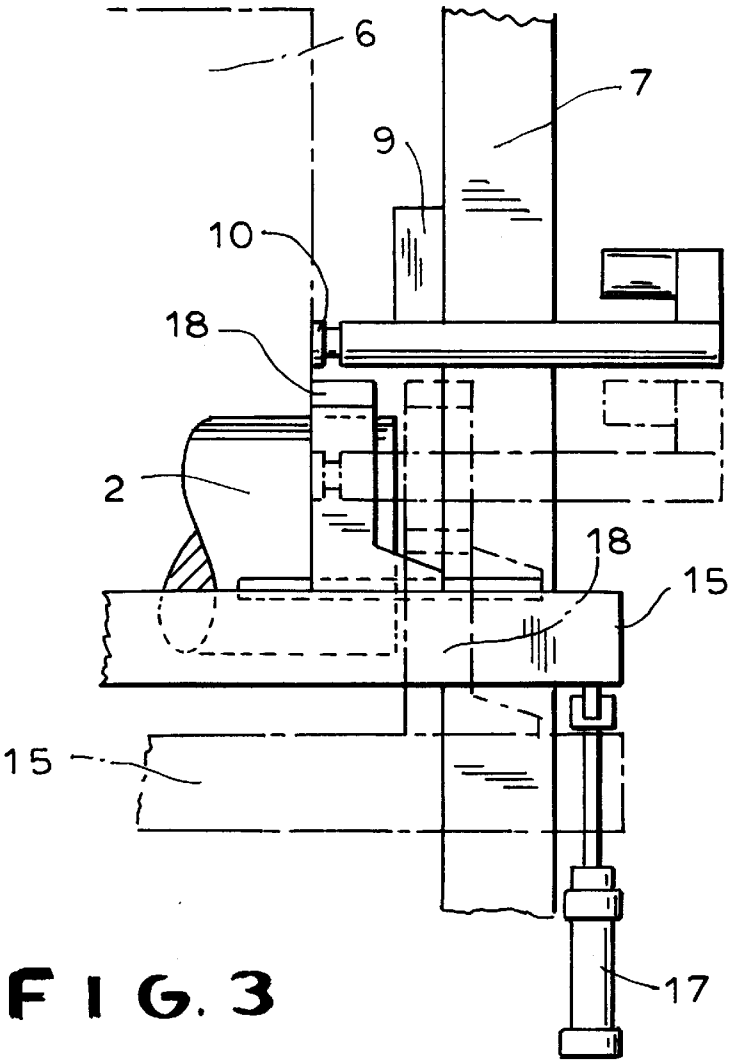
FIGS. 2 and 3 are detail views of the apparatus whereby the axial length of the air receiver can be distinguished.
Figure 2:
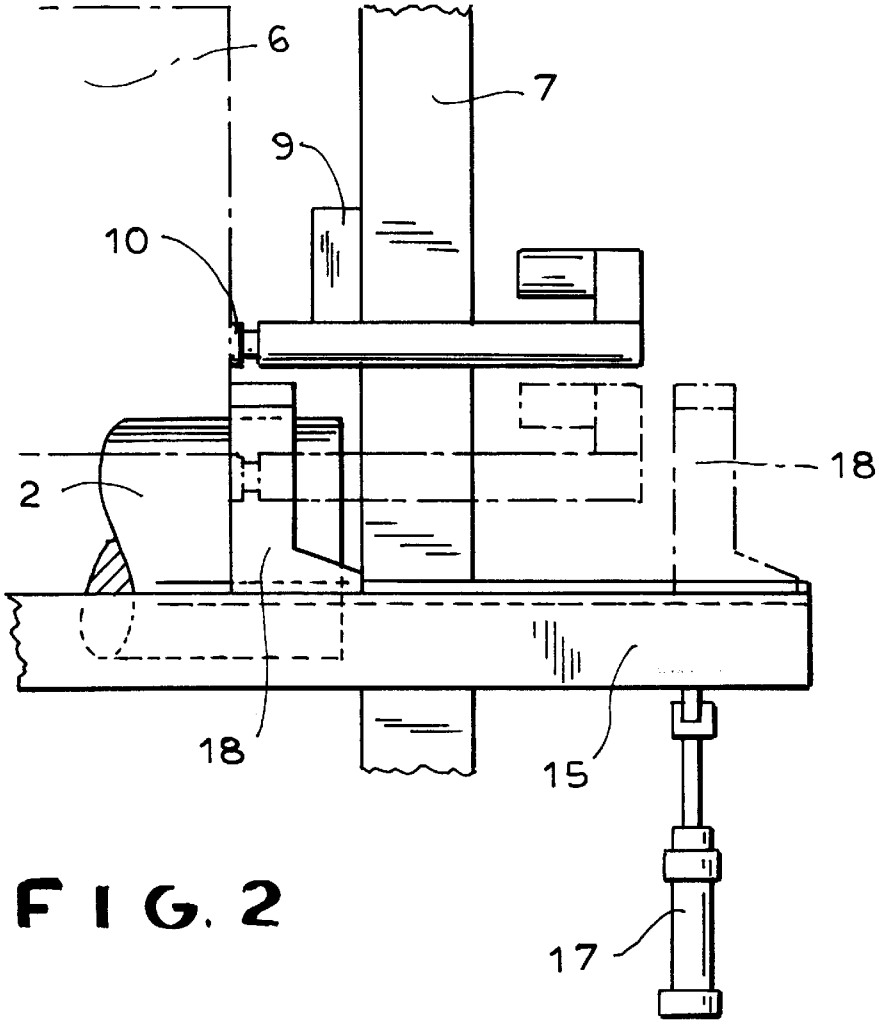
Figure 2A:
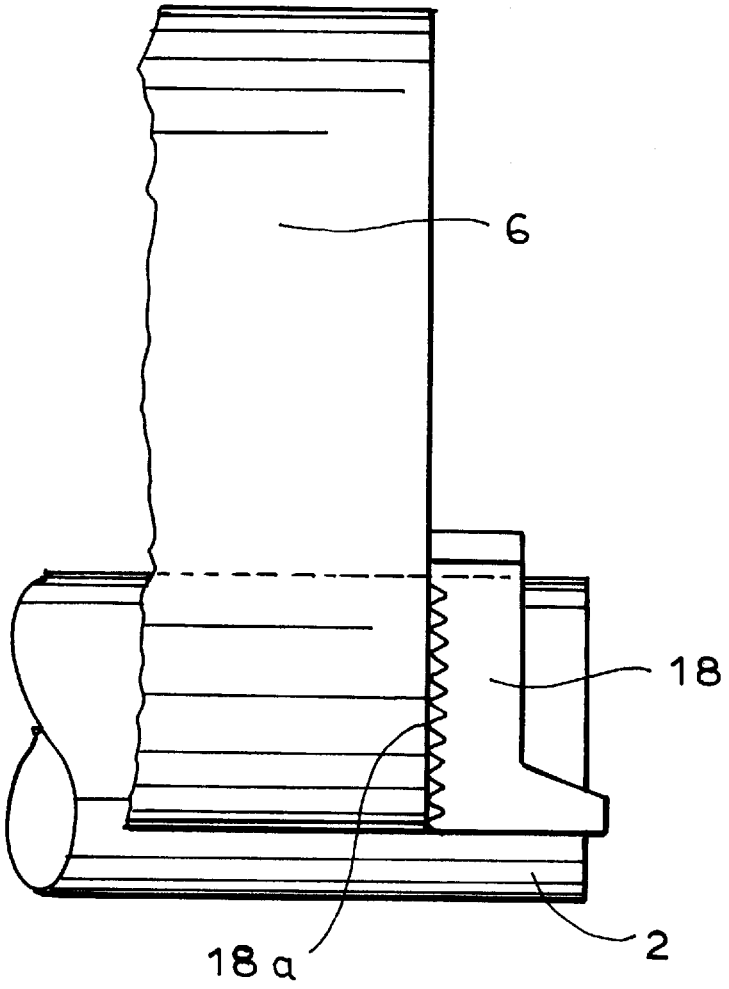
FIG. 2A is a view of a portion of the apparatus of FIG. 2.

In the embodiments according to FIGS. 1 to 3, the upper side of air distributor 15 serves at the same time as a guiding surface for two axially displaceable frontal sealing elements 18, mounted thereon on both sides of the machine. As shown in FIGS. 2 and 3, the air distributor 15 extends beyond the two support cylinders 2, 3 on both sides of the machine, so that the sealing elements 18 can be moved out of the range of support cylinders 2, 3, in axial direction. The shape of the sealing elements 18 fits the free cross-sectional area between the support cylinders 2, 3, whereby the upper part extends rectangularly above the connection line between the two apexes of the two support cylinders 2, 3, in order to insure a large sealing surface for winding rolls 6 with large diameter. The lengthened part of the seal 18 is provided with grooves 18*a* on its side facing the frontal side of winding rolls 6, these grooves acting as a labyrinth seal in the aforedescribed manner, thereby sufficiently reducing the losses of compressed air. On the curved sides facing the support cylinders 2, 3, there are also grooves. These also run across the possible direction of the exit flow, approximately corresponding to the circumference of the respective neighboring support cylinder 2, 3. The sealing elements 18 move laterally next to the guides 7, so that they can be moved against the frontal sides of winding rolls 6, whereby in the sealing position a minimal gap remains to avoid friction.

Adjusting elements (e.g. driven spindles) which are not shown in the drawing and are fastened to the outer side of each sealing element, serve for displacement in the axial direction of the support cylinders 2, 3. In the embodiment according to FIG. 2 the sealing elements can be moved so far outwardly that the sliding carriages 9 with the guide heads 10 can be lowered into the wedge between the two support cylinders 2, 3 and can be introduced into the empty cores 11 which are lying there.

In the embodiment according to FIG. 3, the air receiver with the sealing elements 18 can be lowered so far that the upper edges of sealing elements 18 are below the narrowest point between the two support cylinders 2, 3. In this way the air distributor 15 has to extend less beyond the ends of the support cylinders 2, 3. The axial movement of the sealing elements 18 at the utmost ends of the air distributor 15 require then only a subsequent lowering—either to be swung away or a linear lowering (FIG. 1)—which creates the required free space for the sliding carriage 9.

FIGS. 4 to 10 show preferred embodiments of the invention, wherein the frontal sealing elements 18 can be removed from the lower work area of the guide heads 10, by swinging them in or against the running direction of the web—i.e. away over the support cylinders 2, 3. In this case it is not necessary for the air distributor 15 to extend laterally over the support cylinders 2, 3. Its length will therefore correspond approximately to the length of the support cylinders 2, 3. In order to make an upward swing possible, the sealing elements 118 end at the narrowest point between the support cylinders 2, 3. Correspondingly, the air distributor 115 reaches from below up to this point. On both sides of the machine, the sealing elements 18 are connected with swivel arms 19, 20, whose swivel axes 21, 22 either coincide with the axis of the respective support cylinder or run slightly eccentrically towards the outside on the connection line between the axes of the support cylinders. This slight eccentricity leads to the fact that the lateral surfaces of the sealing elements 118 facing the support cylinders 2, and 3 move slightly away from the respective support-cylinder surface when they are swung outwardly, e.g. to permit the removal of paper residues. If it becomes necessary to move the sealing elements 18 further away from the support cylinders, they are fastened to double levers. In the embodiments according to FIGS. 4 to 7, the sides of the sealing elements 118, 218 and of the air distributor 115, 215 which face the support cylinders 2, 3 and the frontal sides of winding rolls 6 are also provided with the aforedescribed labyrinth packing.

Figure 4:
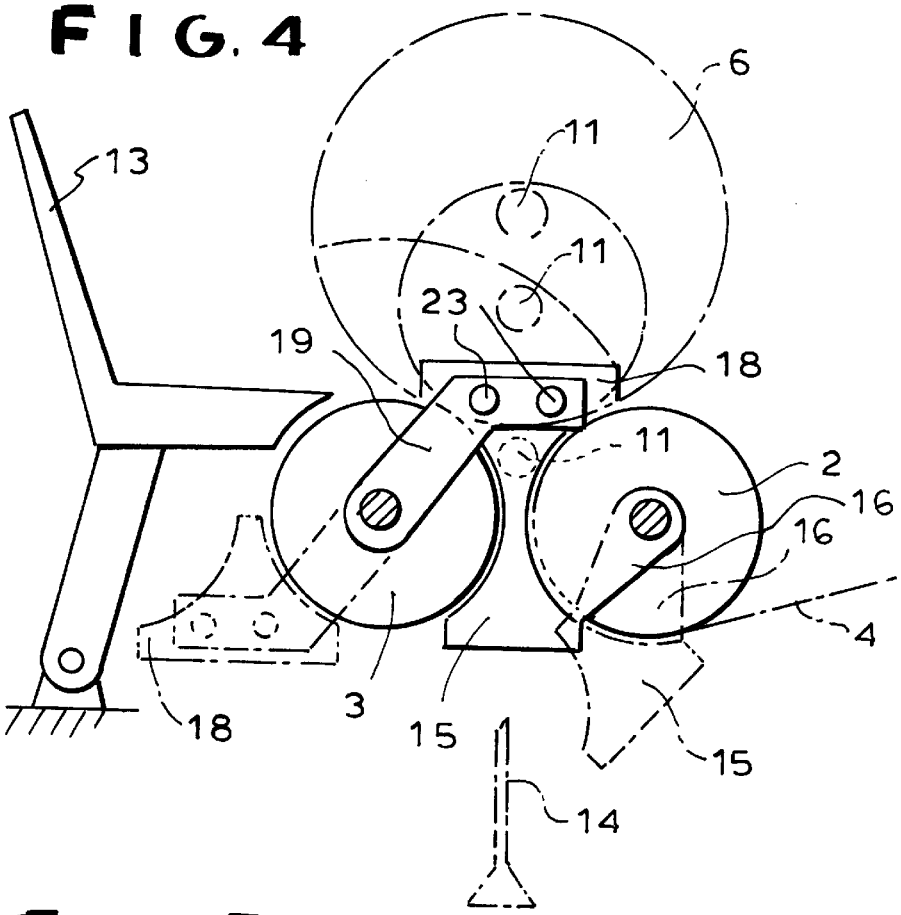
FIGS. 4 and 5 and FIGS. 6 and 7 respectively are each a side view and a fragmentary plan view of two further embodiments wherein only the parts which are essential to the invention are represented.
Figure 5:
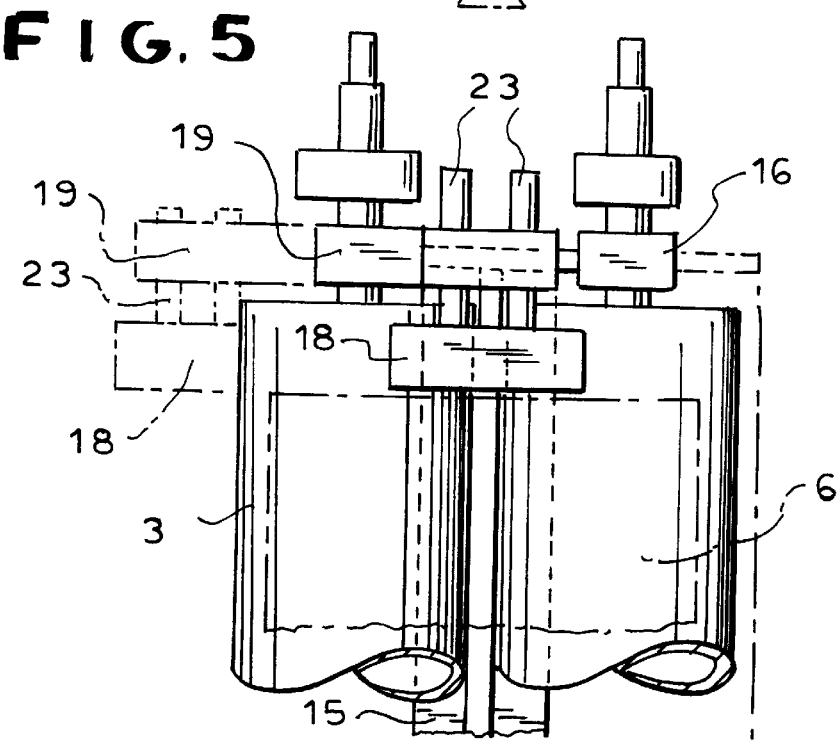
Figure 6:
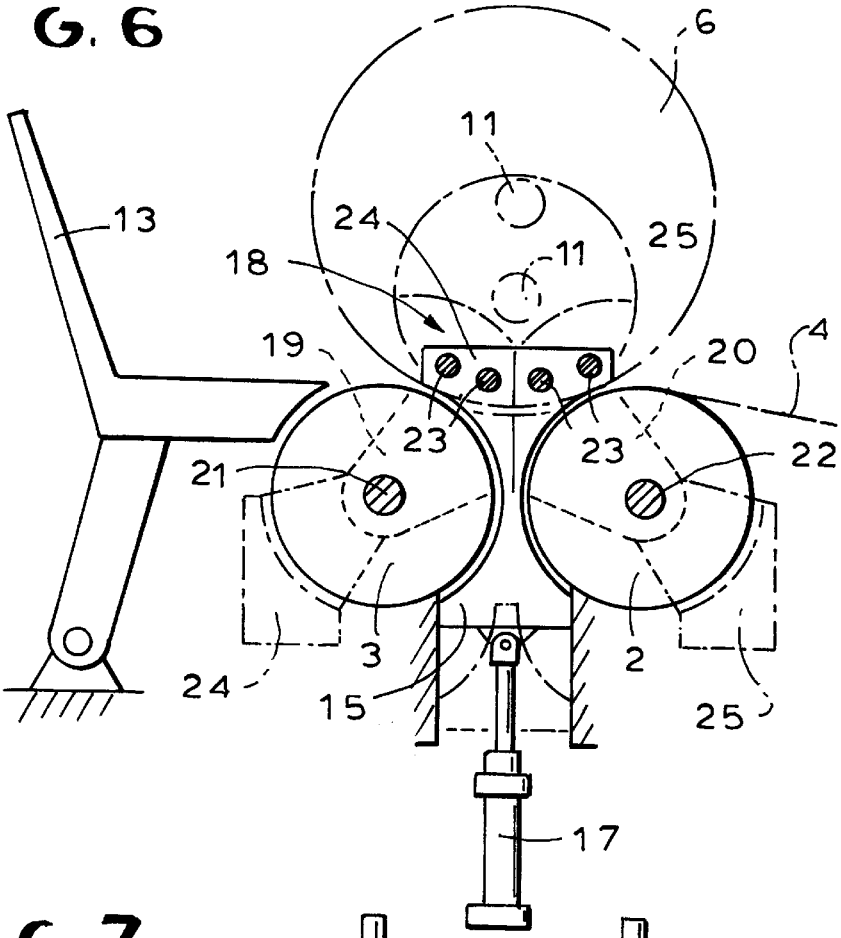
Figure 7:
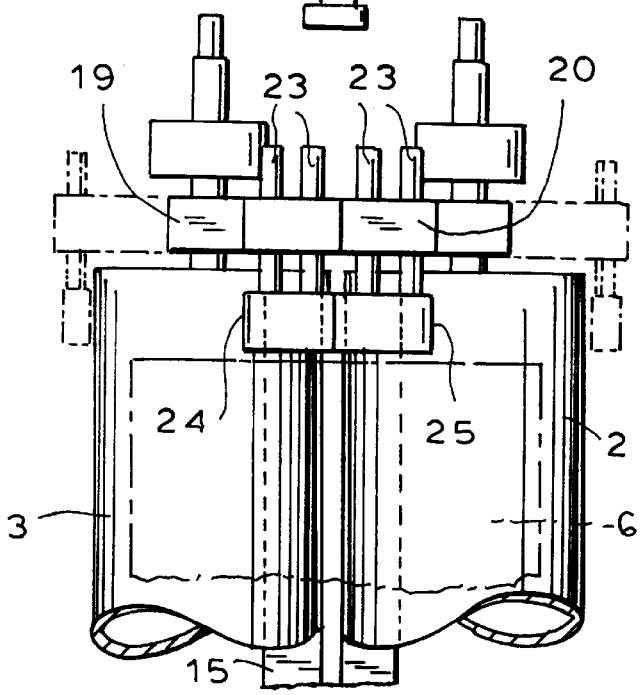

In the embodiments according to FIGS. 4 and 5, the levers 19 which can be swung about the support cylinder 3 on the discharge side carry on each side of the machine a sealing element 118. For this purpose, the levers 19 have angularly shaped ends, so that these run approximately horizontally in the retracted position between the support cylinders 2, 3. At the angularly shaped ends of each of the two swivel arms 19 two round guides are mounted axially slidable and at their inner ends the sealing elements 18 are fastened. In the embodiment according to FIGS. 6 and 7, each frontal sealing element 218 is subdivided along the normal through the middle of the support-cylinder gap. Each of the parts 24, 25 is fastened to a swivel arm 119, 120 which can be swung over the neighboring support cylinder. 2, 3. The swivel motion requires therefore less space—as shown in FIG. 6—so that the sealing elements 218 can be applied at an earlier moment in time.

Figure 8:
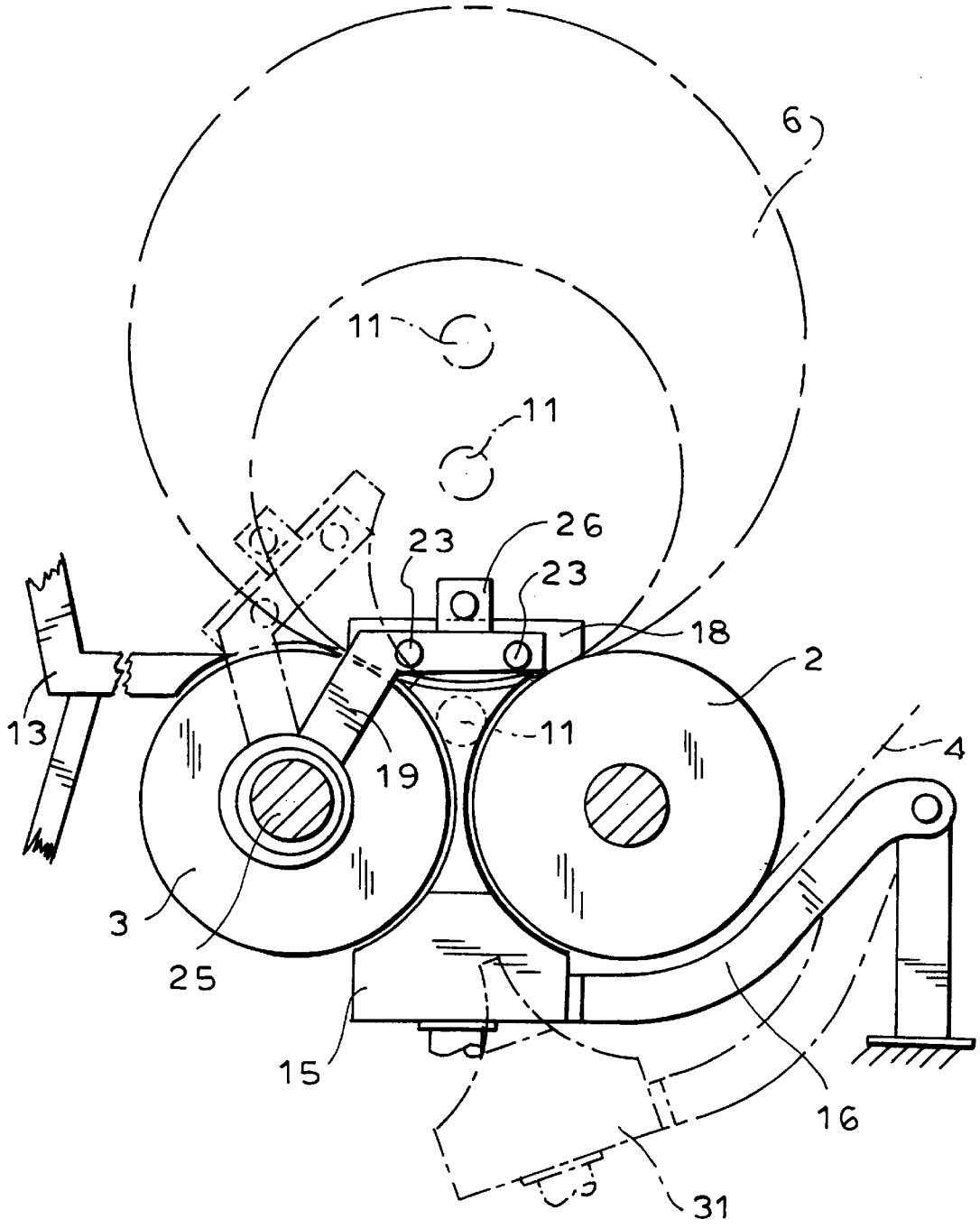
FIG. 8 is a schematic a lateral sectional view of a part of the winding machine with support cylinders, wherein the lateral sealing elements can be pneumatically pressed against outer winding rolls.
Figure 9:
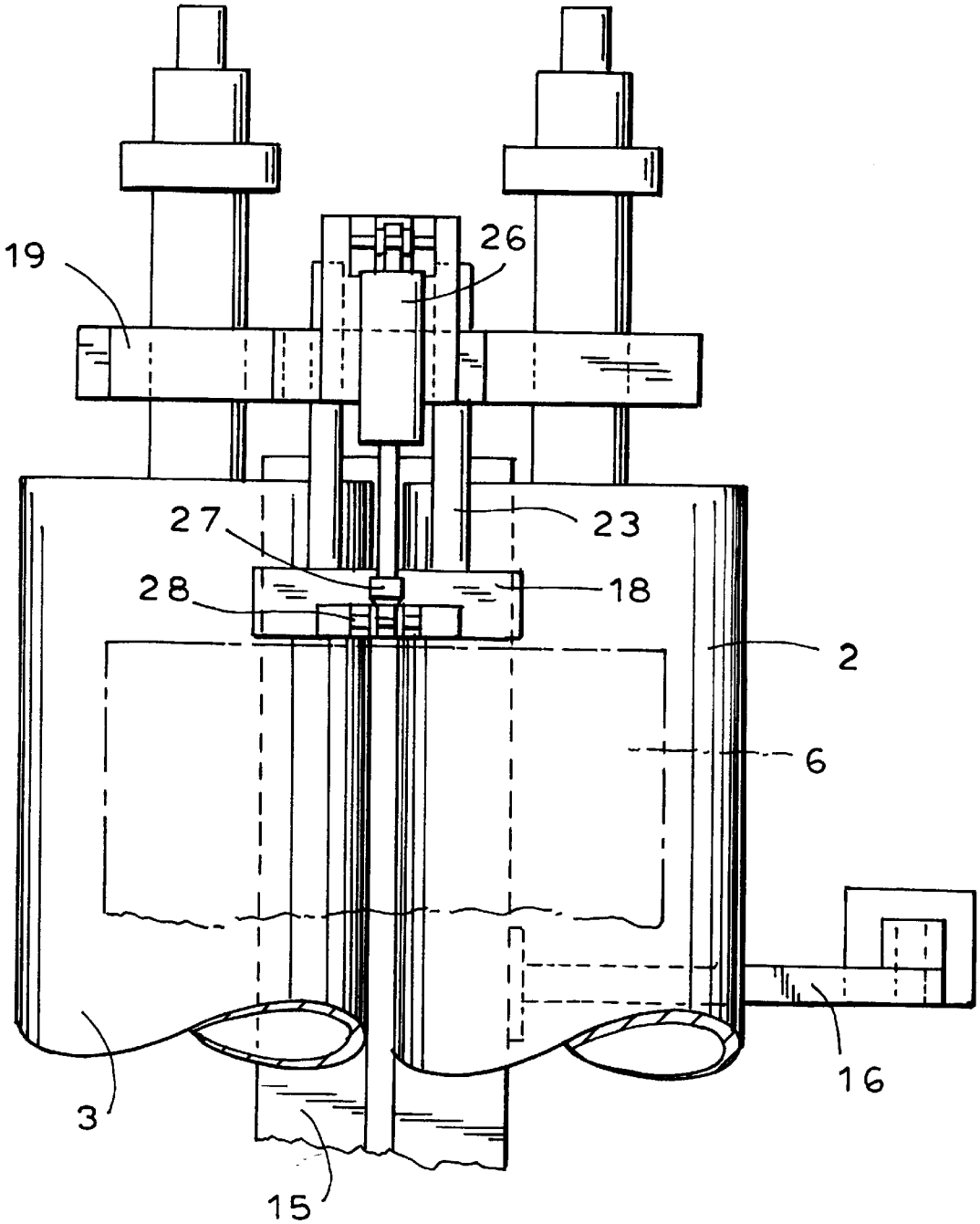
FIG. 9 shows a top view of the winding machine according to FIG. 8.
Figure 10:
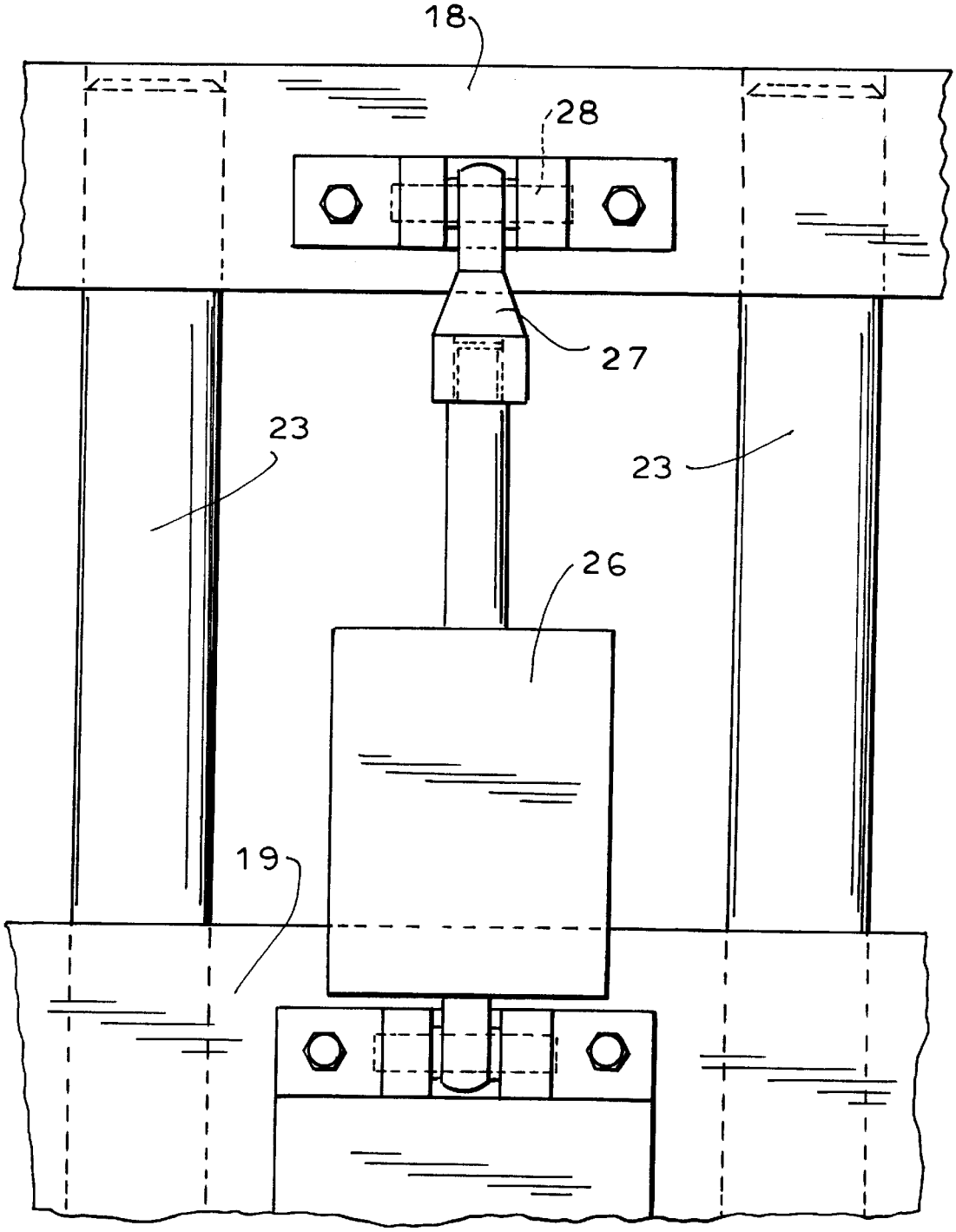
FIG. 10 is an enlarged detail of FIG. 9.

In the embodiment of FIGS. 8 to 10, the sealing elements 318 are also supported so as to be axially slidable—transversely with respect to web 4—on levers 219 which can be swung about the support cylinder 3 on the discharge side. In this way they can be moved by swinging over the support cylinder 3 from the lower working area of guide heads 10 (in FIG. 8 shown in dash-dot lines). The swivel levers 119 are bevelled at their free ends, so that they run approximately horizontally between the support cylinders, 2, 3, in their swung-in position. Their swivel axis 25 runs slightly eccentrically and outwardly offset with respect to the connection line between the support cylinders. The slight eccentricity leads to the fact that during the swinging motion the lateral surfaces of the sealing elements 318 facing the support cylinders 2 or 3 move slightly away from the respective support-cylinder surface, in order to remove for instance paper residues. At each angular end of the two swivel levers 119 two round guides 23 are supported axially slidable, and the sealing elements 318 are fastened to their inner ends. In order to axially displace the sealing elements 318 and to press them against the frontal sides of the outer winding roll 6, the piston 26 of a pneumatic piston-cylinder unit is fastened to the upper side of swivel levers 119. The end of the piston rod 27 is supported on the sealing elements 18 vertically movable about both axes with respect to the guides 23. For that on the upper side of each sealing element an axle 28 is fastened which passes through the eye of the piston rod 27. The pneumatic piston-cylinder unit 26, 27 is connected with a control unit not represented in the drawing for its axial displacement and the setting of adjustable contact pressure.

The piston-cylinder unit 26, 27 serves for the axial displacement of sealing elements 18 in order to accommodate various web width, as well as for pressure against the winding roll 6. It is also possible to have separate drives handle these two assignments. In this case, an electric or hydraulic drive is mounted on the swivel levers 19 for the axial displacement, this drive being connected with the sealing elements 318 via the pneumatic piston-cylinder units 26, 27.

In an embodiment of the invention not illustrated in the drawing the swivel arms bearing the sealing elements 18 are angular, whereby the vertices of the angles are outside the range of the support cylinders 2, 3. The guides extending over the entire length of support cylinders 2, 3 and on which the two sealing elements 18 are slidably supported, are mounted on the vertices of the angles. This way, the guides are no longer axially displaced in order to adjust them to various web width.

After new cores 11 are introduced from above into the support-cylinder cradle, the guide heads 10 are inserted. After the initial portion of the web is fastened to the cores and the pressure roller 24 is applied, the winding process starts.

As long as the contact weight of the winding rolls 6 is not sufficient for the winding hardness, an additional pressure is exerted with the pressure roller 26 in the direction of support cylinders 2, 3. As soon as the contact weight gets too heavy, in the space between the support cylinders 2, 3 and the winding rolls 6 an overpressure is created by the introduction of compressed air, which reduces the contact weight. At this point in time, the winding rolls 6 have reached a sufficiently large diameter (approximately 800 mm), so that their cores 11 and thereby also the sliding carriage 9 are positioned above the support cylinders 2, 3 at a sufficient distance in order to avoid collision with the sealing elements 18. In order to seal the space defined by the winding rolls 6 and the support cylinders 2, 3, first the air distributor 15 is moved into the lower wedge between the support cylinder 2,3, so that the lateral surfaces of 10 the air distributor 15, except for a narrow gap, come to lie against the support cylinders 2, 3, sealing the space downwards. Subsequently, the frontal sealing elements are moved up and inward until only a narrow gap remains towards the frontal side of winding rolls 6, thus also sealing these sides. Compressed air is now fed via air distributor 15, until the pressure built up under the winding rolls 6 is so high that it reduces the contact weight of winding rolls 6 to the desired extent.

In the embodiment according to FIGS. 8 to 10, first compressed air is fed through air distributor 315 in its upswung position, and subsequently the sealing elements 318 are moved axially against the frontal sides of the winding rolls 6 by means of piston-cylinder unit 26, 27. Thereby, the pressure in the piston 26 is controlled so that during the pressure buildup a balance of forces is established and a slight gap between the sealing elements 318 and the winding rolls 6 remains. In this way friction is avoided with minimal losses of compressed air. In case the gap width increases or decreases due to for instance an axial displacement of the winding rolls 6, the overpressure under the winding rolls 6 rises or falls based on increasing or decreasing losses of compressed air. The resulting pressure difference with respect to the pressure in the piston-cylinder unit 26, 27 automatically leads to a correction of the gap width, until the balance of forces is reestablished.

Alternately, a small gap between the sealing elements 318 and the winding rolls 6 can also be maintained by automatically setting a short distance to the position of the guide heads 10.

Preferably, the contact weight of the winding rolls 6 during winding is kept constant. By means of an adjustment or control unit, starting from the desired contact weight the overpressure under the winding rolls 6 is increased so that the weight increase is permanently compensated. The adjustment or control of the winding hardness is considerably simplified in this way, since one of the decisively influencing values, namely the line load at the two contact lines between the winding rolls 6 and the support cylinders 2, 3 no longer changes.

Alternatively, the reduction of the contact weight can also be done in stages by building up a corresponding overpressure, in order to keep the contact weight within a certain range. Also, the contact weight increment can be only partially compensated or the relief can take place only after a predetermined function. Under certain circumstances, a one-time reduction by a constant value may be sufficient. The overpressure buildup constitutes in any case a further parameter for controlling the winding hardness of the winding rolls 6.

In the embodiment of FIGS. 8 to 10, the pressure in the pneumatic piston-cylinder units 26, 27 is also increased by the adjustment device to correspond with the increasing overpressure, in order to keep a constant distance between the sealing elements 18 and the winding rolls 6.

Instead of using labyrinth seals at the sealing surfaces in the upper wedge as well as the lower wedge between the support cylinders 2, 3, it is possible to achieve the sealing by means of an air barrier created by suitably selecting the outlet openings for compressed air. Also, it is possible to enhance the sealing effect of the labyrinth packing by feeding barrier air into its grooves. When the support cylinders 2, 3 are arranged very closely to each other, it can be enough to blow in compressed air from underneath through a slot nozzle at the narrowest point. The compressed air blown in from underneath acts at the same time like an air barrier, thereby reducing losses through the narrow gap between support cylinders 2, 3.

It is also possible to insert sealing elements such as brushes, rubber lips, felt strips, etc., if the friction at the support cylinders 2, 3 and the winding rolls 6 can be kept at a minimum; either by having the sealing elements rest with little friction against the winding rolls 6 and the support cylinders 2, 3, or by positioning them at such a small distance that the losses of compressed air are acceptably low. It is important to watch that the sealing elements do not impair the mutually independent movements of the two support cylinders 2, 3, especially that a frictional lock connection between both support cylinders 2, 3 is not created. Otherwise, different rolling momentums of the support cylinders 2, 3 necessary for influencing the winding quality could no longer be controlled to the desired extent.

We claim:

1. A winding machine for winding a web onto a core, said machine comprising:

two substantially horizontal support cylinders receiving a core on which a web is to be wound and supporting a wound roll formed by winding of said web on said core above a downwardly converging upper wedge-shaped gap between said support cylinders, an upwardly converging lower wedge-shaped gap being defined by said support cylinders below said upper gap and communicating therewith;

an air distributor conforming generally in shape to said lower wedge-shaped gap and connected to a source of air under pressure for creating in said upper wedge-shaped gap a superatmospheric pressure sufficient to provide an upward force on said roll as said roll is wound up, said air distributor sealing said lower wedge-shaped gap and being lowerable at least in part from said lower wedge-shaped gap to enable insertion of a cutter for said web through said lower wedge-shaped gap;

a respective vertically displaceable guide head at each of the opposite ends of said support cylinders and insertable into respective ends of said core;

guide means for each of said guide heads enabling upward movement of said guide heads during winding of said roll and movement of said core away from said support cylinders, said guide heads being lowerable into a region of said upper wedge-shaped gap;

respective sealing elements at longitudinal ends of said upper wedge-shaped gap, displaceable axially toward said ends of said roll for sealing said ends of said upper wedge-shaped gap at said ends of said roll, said sealing elements being adjustable to accommodate different widths of the wound-up webs without frictional locking to said support cylinders, said guide means being spaced axially from said longitudinal ends of said upper wedge-shaped gap to accommodate insertion of said sealing elements between said guide means and said ends of said roll; and means for lowering said air distributor and said sealing elements thereby displacing said sealing elements transverse to an axis of said roll out of paths of said heads, said sealing elements each having a lower portion conforming generally in shape to a cross section of said upper wedge-shaped gap and an upper portion extending upwardly above a line connecting uppermost points of said support cylinders and into a path of said guide heads when said sealing elements are positioned at said ends of said upper wedge-shaped gap.

2. The winding machine defined in claim 1 wherein said air distributor is mounted to enable it to be swung downwardly into a region below one of said support cylinders.

3. The winding machine defined in claim 1 wherein said air distributor extends longitudinally beyond the ends of the support cylinders, said sealing elements being axially displaceably mounted on an upper side of said air distributor.

4. The winding machine defined in claim 1 wherein said sealing elements are provided with means for swinging said sealing elements over one of said support cylinders.

5. The winding machine defined in claim 4 wherein said sealing elements are subdivided into parts so that each part can swing over one of the support cylinders.

6. The winding machine defined in claim 1 wherein said sealing elements are supported on round guides extending parallel to a support-cylinder axis, said winding machine further comprising lateral swivel arms upon which said round guides are fastened and having swivel axes extending generally along a support cylinder axis.

7. The winding machine defined in claim 6 wherein the swivel arms have an angular shape outside a region of the support cylinders and the round guides extend over an entire width of the webs and are fastened to vertices of angles of said swivel arms.

8. The winding machine defined in claim 1 wherein said sealing elements have sealing surfaces formed with grooves running transversely to a direction of flow of air from said upper wedge-shaped gap and forming a labyrinth seal.

9. The winding machine defined in claim 1 wherein said sealing elements have sealing surfaces provided with outlet openings for compressed air directed opposite a flow direction of air from said upper wedge-shaped gap.

10. The winding machine defined in claim 1 wherein said air distributor is provided with seals selected from the group which consists of brushes, rubber lips and felt layers resting with little friction against said support cylinders.

11. The winding machine defined in claim 1 further comprising a pneumatic piston-cylinder unit operatively connected to each of said sealing elements for pressing said sealing elements against respective ends of said rolls.

12. The winding machine defined in claim 11 wherein each of said piston-cylinder units is constructed and arranged for axially displacing said sealing elements for adjustment thereof to different web widths.

13. The winding machine defined in claim 11 further comprising a drive independent of the respective piston-cylinder unit for axially displacing said sealing elements.

14. The winding machine defined in claim 11 wherein said sealing elements are supported on a straight guide parallel to an axis of one of the support cylinders and one of the respective piston-cylinder units is affixed to the respective sealing element so that the respective sealing element is movable about an axis perpendicular to said guide.

* * * * *